US007800573B2

(12) United States Patent
Woo et al.

(10) Patent No.: US 7,800,573 B2
(45) Date of Patent: Sep. 21, 2010

(54) DISPLAY PANEL DRIVING CIRCUIT CAPABLE OF MINIMIZING CIRCUIT AREA BY CHANGING INTERNAL MEMORY SCHEME IN DISPLAY PANEL AND METHOD USING THE SAME

(75) Inventors: Jae-Hyuck Woo, Osan-si (KR); Jae-Goo Lee, Yongin-si (KR); Won-Sik Kang, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1180 days.

(21) Appl. No.: 11/363,902

(22) Filed: Feb. 28, 2006

(65) Prior Publication Data

US 2006/0214898 A1 Sep. 28, 2006

(30) Foreign Application Priority Data

Mar. 22, 2005 (KR) ..... 10-2005-0023648

(51) Int. Cl.
*G09G 3/36* (2006.01)

(52) U.S. Cl. ..... 345/98; 345/99; 345/100; 345/55; 345/204

(58) Field of Classification Search ..... 345/98–100, 345/55, 204
See application file for complete search history.

(56) References Cited

U.S. PATENT DOCUMENTS

| | | | | |
|---|---|---|---|---|
| 6,727,879 | B2 * | 4/2004 | Sako | 345/98 |
| 2004/0041764 | A1 | 3/2004 | Koyama et al. | |
| 2005/0248671 | A1 * | 11/2005 | Schweng | 348/246 |

FOREIGN PATENT DOCUMENTS

| | | |
|---|---|---|
| JP | 10198318 | 7/1998 |
| JP | 10254418 | 9/1998 |
| JP | 00028985 | 1/2000 |
| JP | 04012872 | 1/2004 |
| KR | 20030052992 | 6/2003 |
| TW | 509884 | 11/2002 |
| TW | 583637 | 4/2004 |

* cited by examiner

*Primary Examiner*—Richard Hjerpe
*Assistant Examiner*—Leonid Shapiro
(74) *Attorney, Agent, or Firm*—F. Chau & Associates, LLC

(57) ABSTRACT

Provided is a display panel driving circuit. The display panel driving circuit rearranges and stores image data input of a predetermined number of source lines externally so that data of the same channel neighbor each other, and compares the rearranged data. If the rearranged data are identical, only one buffer is driven, and common data is transferred to a plurality of source lines, outputs the rearranged data according to each channel, sequentially outputs data according to each source line using source drivers of each channel. Thus, when output data neighboring source lines are identical, the current required for the buffer is reduced.

10 Claims, 11 Drawing Sheets

DISPLAY PANEL DRIVING CIRCUIT CAPABLE OF MINIMIZING CIRCUIT AREA BY CHANGING INTERNAL MEMORY SCHEME IN DISPLAY PANEL AND METHOD USING THE SAME

CROSS-REFERENCE TO RELATED APPLICATION

This application claims the benefit of Korean Patent Application No. 10-2005-0023648, filed on Mar. 22, 2005, in the Korean Intellectual Property Office, the disclosure of which is incorporated by reference herein.

BACKGROUND OF THE INVENTION

1. Field of the Invention

The present invention relates to a liquid crystal display (LCD) panel such as a thin film transistor, low voltage differential signaling, display interface (TFT-LDI), and more particularly, to a display circuit capable of minimizing an arrangement area required to drive a display panel and a method of driving the display panel using the display circuit.

2. Description of the Related Art

In a gate driver and a source driver used to drive an LCD panel, the gate driver sequentially activates gate lines of the panel, and the source driver transfers data to cells connected to the activated gate lines.

FIG. 1 is a circuit diagram of a conventional source driver 100. Referring to FIG. 1, color data that indicates color to be displayed on a panel 102 includes three channel data, red (R) channel data DATA_R, green (G) channel data DATA_G, and blue (B) channel data DATA_B. When the three channel data are supplied to a cell of the panel 102, the cell produces a color.

A decoder DR receives the R channel data DATA_R and generates a corresponding R voltage signal R_VOL. The R voltage signal R_VOL is output after being buffered by an R buffer R_BUF. An output node RBON of the R buffer R_BUF and an R output node ROUT are connected or disconnected by a switch R_SW controlled by a connection control signal R_COCON.

If the switch R_SW is closed, the R voltage signal R_VOL is supplied to a corresponding cell R of the panel 102.

A decoder DG receives the G channel data DATA_G and generates a corresponding G voltage signal G_VOL. The G voltage signal G_VOL is output after being buffered by a G buffer G_BUF. An output node GBON of the G buffer G_BUF and a G output node GOUT is connected or disconnected by a switch G_SW controlled by a connection control signal G_COCON.

If the switch G_SW is closed, the G voltage signal G_VOL is supplied to a corresponding cell G of the panel 102.

A decoder DB receives the B channel data DATA_B and generates a corresponding B voltage signal B_VOL. The B voltage signal B_VOL is output after being buffered by a B buffer B_BUF. An output node BBON of the B buffer B_BUF and a B output node BOUT is connected or disconnected by a switch B_SW controlled by a connection control signal B_COCON.

If the switch B_SW is closed, the B voltage signal B_VOL is supplied to a corresponding cell B of the panel 102.

The R voltage signal R_VOL, the G voltage signal G_VOL, and the B voltage signal B_VOL are supplied to the same cell to make the cell produce a color. The source driver 100 includes a plurality of the decoders DR, DG, and DB, the buffers R_BUF, G_BUF, and B_BUF, and the switches R_SW, G_SW, and B_SW corresponding to the channel data DATA_R, DATA_G, and DATA_B in a number equal to the number of source lines of the panel 102.

The decoder DR, the R buffer R_BUF, and the switch R_SW that receive the R channel data DATA_R and supply the received data to a corresponding cell form a channel. Therefore, three channels are required for a cell to produce a color.

When image data is displayed on a display panel, the displayed color in a cell is usually similar to the color produced by neighboring cells. To be more specific, video and picture data along with image data are usually similar in a group of neighboring cells in a predetermined region. Thus, current is wasted when buffers of the R, G, and B channels of all of the source lines are driven.

To reduce this waste of current, when data or colors of two neighboring cells are identical, buffers of the neighboring cells are driven to output the same data.

FIG. 2 is a circuit diagram of a conventional display panel driving circuit using a reduced amount of current. The conventional display panel driving circuit 200 drives a buffer corresponding to a cell according to whether neighboring cells are to produce the same color. Referring to FIG. 2, the display panel driving circuit 200 includes an internal memory 202, a source driver 204, and a panel 206. The source driver 204 includes a latch unit 208, a data comparator 210, channel buffers R0_BUF through B1_BUF, and a plurality of switches R_A, G_A, B_A, R_B, G_B, B_B, R_C, G_C, and B_C.

The switch R_A is connected between a first R channel buffer R0_BUF and an R channel line of a first source line, the switch G_A is connected between a first G channel buffer G0_BUF and a G channel line of the first source line; the switch B_A is connected between a first B channel buffer B0_BUF and a B channel line of the first source line, the switch R_B is connected between a second R channel buffer R1_BUF and an R channel line of a second source line, the switch G_B is connected between a second G channel buffer G1_BUF and a G channel line of the second source line, the switch B_B is connected between a second B channel buffer B1_BUF and a B channel line of the second source line, the switch R_C is connected between an output node of the switch R_A and an output node of the switch R_B, the switch G_C is connected between an output node of the switch G_A and an output node of the switch G_B, and the switch B_C is connected between an output node of the switch B_A and an output node of the switch B_B.

The source driver 204 is a unit source driver including two source lines R0, G0, B0 and R1, G1, B1 in parallel connected therebetween. The unit source driver constitutes a pre-source driver of the display panel driving circuit 200. It is assumed that channel data of each cell includes 6 bits of data.

The operation of the conventional display panel driving circuit 200 will now be described with reference to FIG. 2. The internal memory 202 sequentially stores image data input externally in cell units. The internal memory 202 sequentially stores in order R0 channel data, G0 channel data, B0 channel data, R1 channel data, G1 channel data, and B1 channel data for a cell. The latch unit 208 latches 18-bit data read from the internal memory 202 and simultaneously outputs a first switching signal A. The data comparator 210 compares each of the channel data output from the latch unit 208 and determines whether two source lines have the same image data. For such a determination, the data comparator 210 determines whether the respective channel data of each source line are identical. To be more specific, the data comparator 210 compares 6-bit first R channel data R0<6> with 6-bit second R channel data R1<6>, compares 6-bit first G channel data G0<6> with 6-bit second G channel data G1<6>, and compares 6-bit first B channel data B0<6> with 6-bit second B channel data B1<6>.

The data comparator 210 determines that data transferred to two neighboring cells are identical if the channel data matches from an MSB (most significant bit) to an LSB (least significant bit). The data comparator 210 outputs a second switching signal B if the data are determined to be different, and outputs a third switching signal C if the data are determined to be identical.

If the data are determined to be identical, the channel buffers R0_BUF, G0_BUF, and B0_BUF corresponding to the first source line are activated and the channel buffers R1_BUF, G1_BUF, and B1_BUF corresponding to the second source line are deactivated.

The switches R_A, G_A, and B_A are closed in response to the first switching signal A, the switches R_B, G_B, and B_B are closed in response to the second switching signal B, and the switches R_C, G_C, and B_C are closed in response to a third switching signal C. Therefore, when the data are determined to be identical, the switches R_A, G_A, B_A, R_C, G_C, and B_C are closed, and the switches R_B, G_B, and B_B are opened. As a result, the channel data output in the channel buffers R0_BUF, G0_BUF, and B0_BUF corresponding to the first source line can be transmitted to the first and second source lines.

If image data of neighboring cells are identical, buffers corresponding to a cell are driven to display an image. The display panel driving circuit 200 can reduce current consumption by 25% for a white pattern or a black pattern.

However, since the display panel driving circuit 200 compares each bit of the MSB/LSB of each channel using the data comparator 210, lines connecting the latch unit 208 and the data comparator 210 are connected to input image data output from the latch unit 208 in the same channel, as shown in FIG. 2. To be more specific, the inputs of the 6-bit second R channel data R1<6>, the second G channel data G1<6>, and the second B channel data B1<6> are connected to the inputs of the 6-bit first R channel data R0<6>, the 6-bit first G channel data G0<6> and the 6-bit first B channel data B0<6>, respectively. Therefore, a routing space between the latch unit 208 and the data comparator 210 is expanded. For example, when a display panel driving circuit includes the data comparator 210 with a height of 35 μm, the routing space is 17.5 μm, which occupies more than half of the height.

It is also difficult to use only one buffer (or amplifier) in the conventional display panel driving circuit when handling N channels.

SUMMARY OF THE INVENTION

The present invention provides a display panel driving circuit capable of reducing current consumption of a display panel and minimizing an arrangement area of a source driver.

The present invention also provides a display panel driving circuit using an N-channel and one amplifier for driving a buffer to reduce current consumption of a display panel when a predetermined number of neighboring cells include the same image data.

According to an aspect of the present invention, there is provided a display driving circuit comprising a source driver including a plurality of unit source drivers connected in parallel, connected to first and second source lines to control the first and second source lines, memory rearranging and storing image data of the first and second source lines where channels having the same color neighbor each other, and a display panel, wherein the plurality of unit source drivers comprises a data comparator receiving the image data of the first and second source lines from the memory, determining whether the image data of the first and second source lines are identical, outputting a first switching signal if the image data of the first and second source lines are determined to be different, and outputting a second switching signal if the image data of the first and second source lines are determined to be identical, a plurality of buffers amplifying image data output from the data comparator, and a controller including a plurality of switches connected between the plurality of buffers and channel lines of the first and second source lines and outputting the image data output from the plurality of buffers to the channel lines of the first and second source lines in response to the first and second switching signals, wherein the controller activates buffers corresponding to one of the first and second source lines among the plurality of buffers in response to the second switching signal and deactivates the other buffers and transfers a signal output from the activated buffers to the channel lines of the first and second source lines.

The first and second source lines may neighbor each other. The image data of the first and second source lines includes first and second red (R), green (G), and blue (B) channel data of the first and second source lines, respectively, and the data comparator determines that the image data of the first source line is identical to the image data of the second source line if the first R channel data is identical to the second R channel data, the first G channel data is identical to the second G channel data, and the first B channel data is identical to the second B channel data.

The display driving circuit may further comprise a logic controller generating and outputting an internal bit write enable signal that repeatedly transitions between a first logic state and a second logic state when image data of one of the first and second source lines is input in response to a bit write enable signal input externally, wherein the image data of the first and second source lines input externally are rearranged and stored in the memory so that channel lines of the first and second source lines having the same color neighbor each other in response to the internal bit write enable signal.

The display driving circuit may further comprise a dummy data generator generating 3n-bit dummy data corresponding to each of first or second R, G, and B channel data containing n bits each, and a summation unit cross-summing the n-bit data of each of the first or second R, G, and B channel data of the 3n-bit dummy data and 3n-bit source line image data and generating 6n-bit data, wherein the memory stores pixel data of the first source line among a first 6n-bit data output from the summation unit when the internal bit write enable signal is in the first logic state, and pixel data of the second source line among a next 6n-bit data output from the summation unit when the internal bit write enable signal is in the second logic state.

According to still another aspect of the present invention, there is provided a display driving circuit comprising a source driver including a plurality of unit source drivers connected in parallel, connected to first and second source lines to control the first and second source lines, memory rearranging and storing image data of the first and second source lines where channels having the same color neighbor each other, and a display panel, wherein the plurality of unit source drivers comprises a data comparator receiving the image data of the first and second source lines from the memory, determining whether the image data of the first and second source lines are identical, outputting a first switching signal if the image data of the first and second source lines are determined to be different, and outputting a second switching signal if the image data of the first and second source lines are determined to be identical, a first controller controlling the first source line, and a second controller controlling the second source line, wherein one of the first and second controllers is activated and the other of the first and second controllers is deactivated in response to the second switching signal, and an output signal of the activated controller is transferred to the first and second source lines.

The first controller may include a first buffer that sequentially outputs the first R, G, and B channel data, and the second controller may include a second buffer that sequentially outputs the second R, G, and B channel data.

According to still another aspect of the present invention, there is provided a display driving circuit comprising a source driver including a plurality of unit source drivers connected in parallel, connected to a plurality of source lines to control the source lines, memory rearranging and storing image data of the plurality of source lines where channels having the same color neighbor each other, and a display panel, wherein the plurality of unit source drivers comprises a data comparator receiving the image data of the plurality of source lines from the memory, determining whether the image data of the plurality of source lines are identical, outputting a first switching signal if the image data of the plurality of source lines are determined to be different, and outputting a second switching signal if the image data of the plurality of source lines are determined to be identical, and a plurality of controllers amplifying the output image data of the data comparator and controlling the output image data to each of the source lines, wherein one of the plurality of controllers is activated and other controllers are deactivated in response to the second switching signal, and an output signal of the activated controller is transferred to the plurality of source lines.

According to yet another aspect of the present invention, there is provided a display driving circuit comprising a source driver including a plurality of unit source drivers connected in parallel, connected to a plurality of source lines to control the source lines, memory, and a display panel, wherein the plurality of unit source drivers comprises a red (R) channel multiplexer receiving R channel data among image data of the source lines stored in the memory and sequentially outputting the image data of the source lines, a green (G) channel multiplex receiving G channel data among the image data of the source lines stored in the memory and sequentially outputting the image data of the source lines, a B channel multiplexer receiving B channel data among the image data of the source lines stored in the memory and sequentially outputting the image data of the source lines, a latch unit receiving and latching outputs of the R, G, and B channel multiplexers, an R channel controller that sequentially receives the R channel data of the source lines from the latch unit and is connected to R channel pixels of the source lines, a G channel controller sequentially receiving the G channel data among the output image data of the latch unit by each source line and connected to G channel pixels of each source line, and a B channel controller sequentially receiving the G channel data among the output image data of the latch unit by each source line and connected to B channel pixels of each source line, wherein the R, G, and B channel controllers sequentially output the sequentially input image data of the source lines to each of an R channel pixel line, a G channel pixel line, and a B channel pixel line of the source lines.

According to further another aspect of the present invention, there is provided a method of driving a display circuit, the method comprising rearranging and storing image data input externally according to a predetermined number of source lines where channel data having the same color neighbor each other, reading and latching the rearranged image data, determining whether the image data of the predetermined number of source lines are identical, and if the image data of the predetermined number of source lines are different, independently transferring the image data to corresponding source lines, and if the image data of the predetermined number of source lines are identical, activating only a buffer connected to one of the source lines and deactivating buffers connected to the other source lines, and transferring the output image data of the activated buffer to a source line connected to the deactivated buffer.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF PREFERRED EMBODIMENTS

Figure 1:
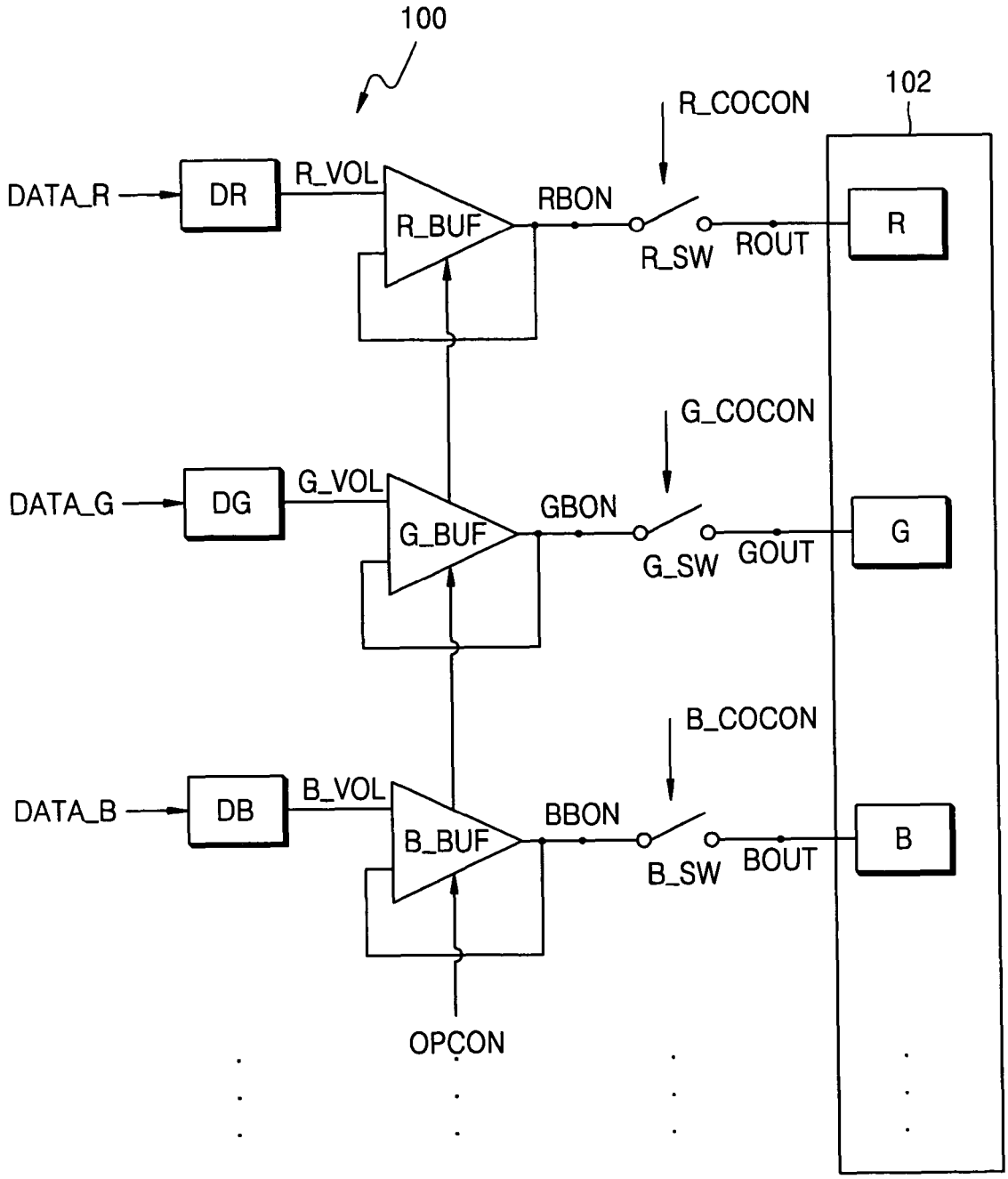
FIG. 1 (PRIOR ART)
FIG. 1 is a circuit diagram of a conventional source driver.

The present invention will now be described more fully with reference to the accompanying drawings, in which exemplary embodiments of the invention are shown. Like reference numerals represent like elements throughout the drawings.

Figure 2:
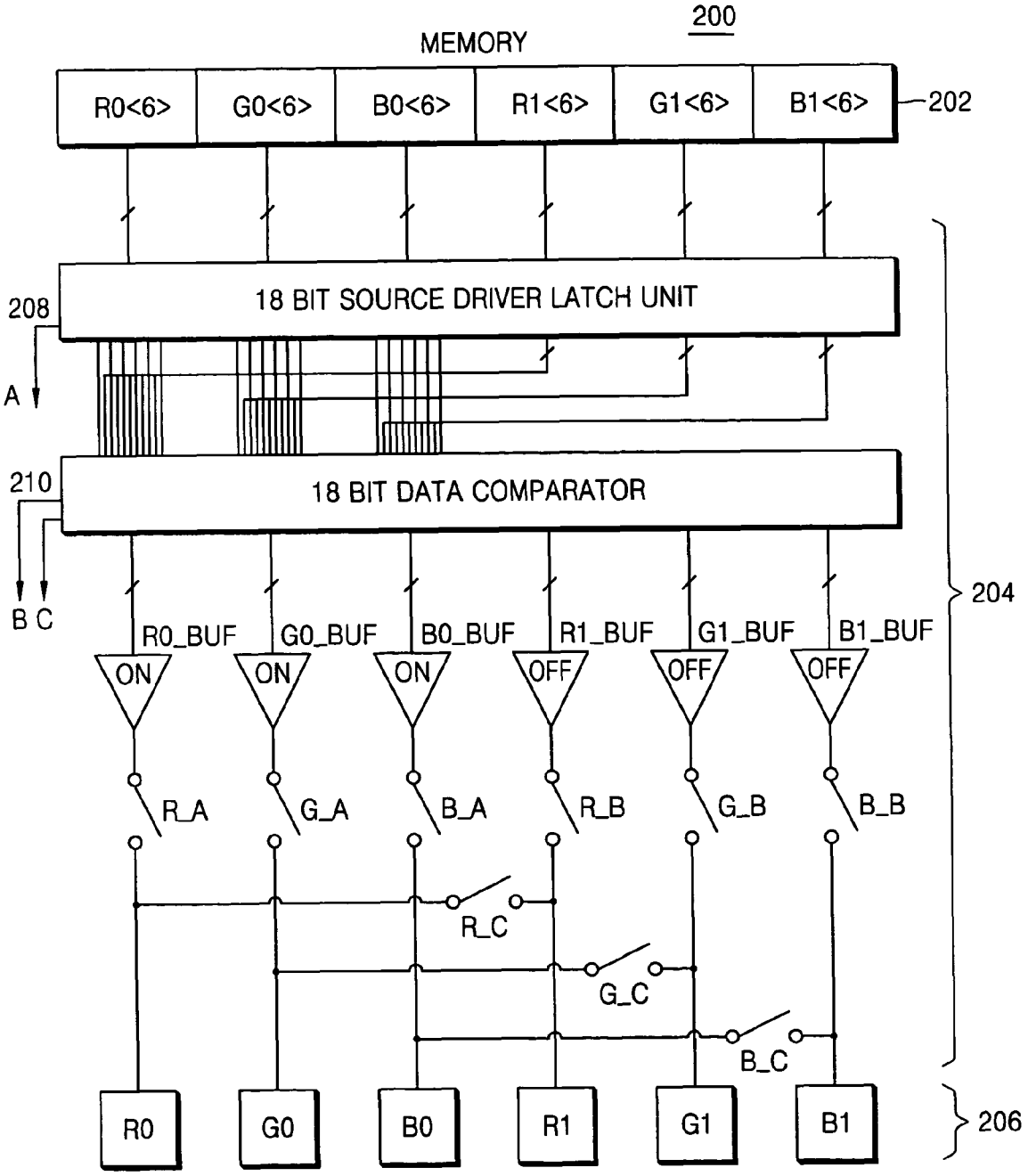
FIG. 2 (PRIOR ART)
FIG. 2 is a circuit diagram of a conventional display panel driving circuit using a reduced amount of current.
Figure 3:
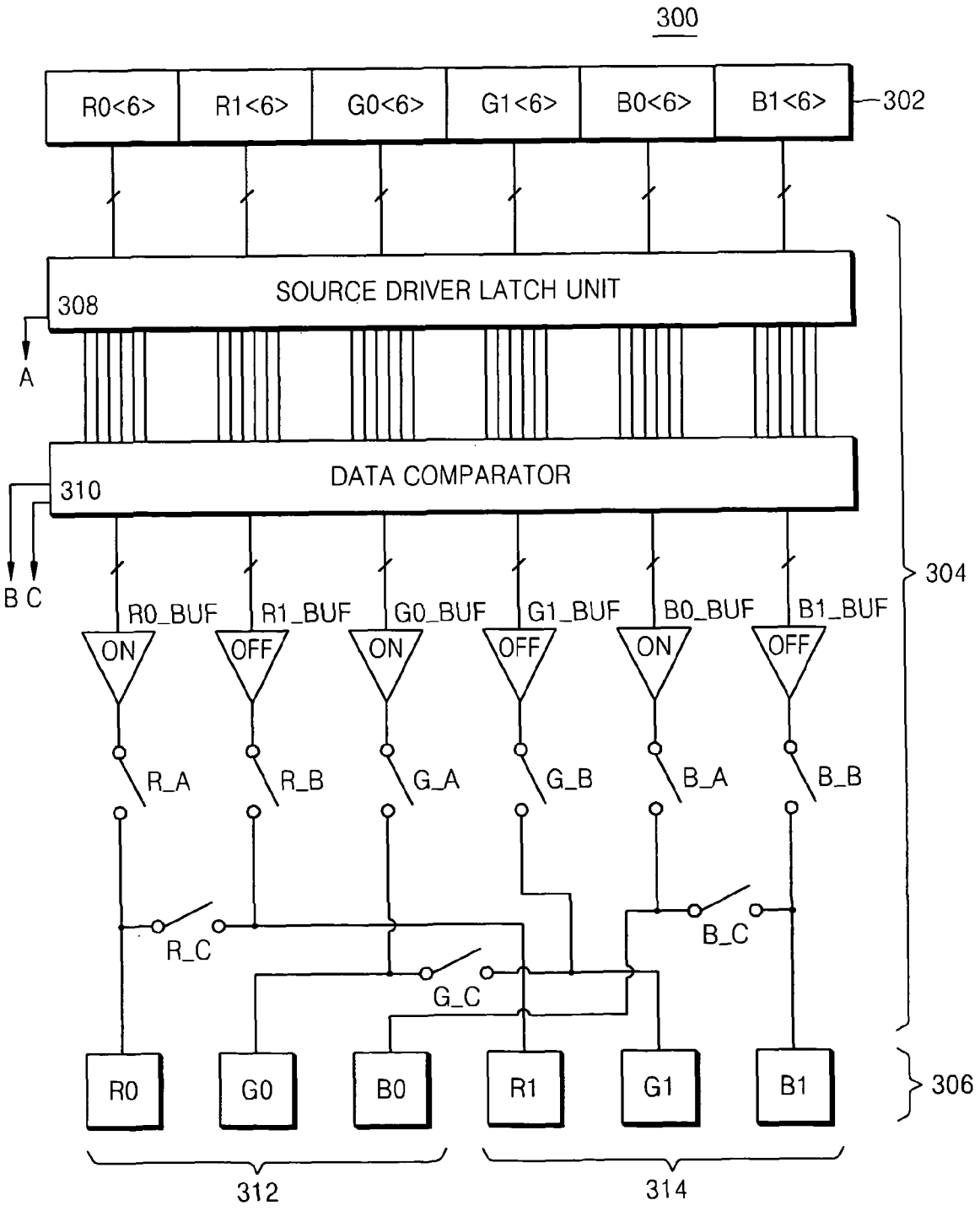
FIG. 3 is a circuit diagram of a display panel driving circuit according to an embodiment of the present invention.

FIG. 3 is a circuit diagram of a display panel driving circuit according to an embodiment of the present invention. The display panel driving circuit 300 drives a buffer corresponding to a cell according to whether two neighboring cells are to produce the same color, and is identical to the display panel driving circuit 200 shown in FIG. 2. Referring to FIG. 3, the display panel driving circuit 300 includes an internal memory 302, a source driver 304, and a panel 306. The source driver 304 includes a latch unit 308, a data comparator 310, a plurality of channel buffers R0_BUF, R1_BUF, G0_BUF, G1_BUF, B0_BUF, and B1_BUF, and a plurality of switches R_A, R_B, R_C, G_A, G_B, G_C, B_A, B_B, and B_C.

The source driver 304 is a unit source driver including a first source line 312 including an R channel line R0, a G channel line G0, and a B channel line B0 and a second source line 312 including an R channel line R1, a G channel line G1, and a B channel line B1 that are connected in parallel to form a pre-source driver of the display panel driving circuit 300. For this exemplary embodiment, the channel data is 6-bit data.

The internal memory 302 receives image data input externally, rearranges image data of a predetermined number of source lines such that channels having the same color neighbor each other, and stores the rearranged image data. The internal memory 302 rearranges image data of the first and second source line units 312 and 314 such that data of an R channel, a G channel, and a B channel neighbor each other and stores the rearranged image data.

The latch unit 308 receives and latches image data corresponding to two source lines output from the internal memory 302 and simultaneously outputs a first switching signal A. The data comparator 310 compares each channel data in parallel output in the latch unit 308, determines whether image data of two source lines are identical, and outputs a second switching signal B and a third switching signal C according to the determination result. The data comparator 310 activates or deactivates each channel buffer according to the comparison result and outputs image data on the activated channel buffer.

The first R channel buffer R0_BUF amplifies R channel data of the first source line 312 received from the data comparator 310. The second R channel buffer R1_BUF amplifies R channel data of the second source line 312 received from the data comparator 310. The first G channel buffer G0_BUF amplifies G channel data of the first source line 312 received from the data comparator 310. The second G channel buffer G1_BUF amplifies G channel data of the second source line 314 received from the data comparator 310. The first B channel buffer B0_BUF amplifies B channel data of the first source line 312 received from the data comparator 310. The second B channel buffer B1_BUF amplifies B channel data of the second source line received 314 from the data comparator 310.

The switch R_A is connected between the first R channel buffer R0_BUF and the R channel line R0 of a first source line 312, the switch R_B is connected between the second R channel buffer R1_BUF and the R channel line R of a second source line 314, and the switch R_C is connected between an output node of the switch R_A and an output node of the switch R_B. The switch G_A is connected between the first G channel buffer G0_BUF and the G channel line G0 of the first source line 312, the switch G_B is connected between the second G channel buffer G1_BUF and the G channel line G1 of the second source line 314, and the switch G_C is connected between an output node of the switch G_A and an output node of the switch G_B. The switch B_A is connected between the first B channel buffer B0_BUF and the B channel line B0 of the first source line 312, the switch B_B is connected between the second B channel buffer B1_BUF and the B channel line B1 of the second source line 314, and the switch B_C is connected between an output node of the switch B_A and an output node of the switch B_B.

The operation of the display panel driving circuit 300 will now be described with reference to FIG. 3. If 18-bit image data of the first source line 312 is input externally, the internal memory 302 stores first R channel data R0<6> in a first 6-bit register, first G channel data G0<6> in a third register by skipping a second register, and first B channel data B0<6> in a fifth register by skipping a fourth register. If 18-bit image data of the second source line 314 is input externally, the internal memory 302 stores second R channel data R1<6> in the second register by skipping the first register, second G channel data G1<6> in the fourth register by skipping the third register, and second B channel data B1<6> in a sixth register by skipping a fifth register. As a result, the second R channel data R1<6>is stored next to the first R channel data R0<6>, the second G channel data G1<6> is stored next to the first G channel data G0<6>, and the second B channel data B1<6> is stored next to the first B channel data B0<6>.

The latch unit 308 receives and latches each of the 36 bits of the channel data R0<6>, R1<6>, G0<6>, G1<6>, B0<6>, and B1<6> corresponding to the first and second source lines and simultaneously outputs the first switching signal A to the switches R_A, G_A, and B_A.

The data comparator 310 compares 36-bit image data for the first and second source lines 312 and 314 output from the latch unit 308 and determines whether the image data are identical. If the image data are determined not to be identical, the second switching signal B is output. If the image data are determined to be identical, the third switching signal C is output. The data comparator 310 compares the 6-bit first R channel data R0<6> with the 6-bit second R channel data R1<6>, the 6-bit first G channel data G0<6> with the 6-bit second G channel data G1<6>, and the 6-bit first B channel data B0<6> with the 6-bit second B channel data B1<6>. The data comparator 310 determines that data transferred to the two neighboring cells are identical if each channel data are matched from an MSB (most significant bit) and an LSB (least significant bit).

If the data transferred to the two neighboring cells are not identical, the second switching signal B is output. The first R channel data R0<6> is output to the first R channel buffer R0_BUF, the second R channel data R1<6> is output to the second R channel buffer R1_BUF, the first G channel data G0<6> is output to the first G channel buffer G0_BUF, the second G channel data G1<6> is output to the second G channel buffer G1_BUF, the first B channel data B0<6> is output to the first B channel buffer B0_BUF, and the second B channel data B1<6> is output to the second B channel buffer B1_BUF.

The switches R_A, G_A, and B_A are closed in response to the first switching signal A. The switches R_B, G_B, and B_B are closed in response to the second switching signal B. The switches R_C, G_C, and B_C remain open. As a result, the first R channel data R0<6> is output to the R channel line R0 of the first source line 312 through the first R channel buffer R0_BUF, the first G channel data G0<6> is output to the G channel line G0 of the first source line 312 through the first G channel buffer G0_BUF, the first B channel data B0<6> is output to the B channel line B0 of the first source line 312 through the first B channel buffer B0_BUF. The second R channel data R1<6> is output to the R channel line R1 of the second source line 314 through the second R channel buffer R1_BUF, the second G channel data G1<6> is output to the G channel line G1 of the second source line 314 through the second G channel buffer G1_BUF, and the second B channel data B1<6> is output to the B channel line B1 of the second source line 314 through the second B channel buffer B1_BUF.

If the data transferred to the two neighboring cells are identical, the third switching signal C is output. The first R channel data R0<6> is output to the first R channel buffer R0_BUF, the first G channel data G0<6> is output to the first G channel buffer G0_BUF, and the first B channel data B0<6> is output to the first B channel buffer B0_BUF. The second R channel buffer R1_BUF, the second G channel buffer G1_BUF, and the second B channel buffer B1_BUF are deactivated.

The switches R_A, G_A, and B_A are closed in response to the first switching signal A. The switches R_C, G_C, and B_C are closed in response to a third switching signal C. The switches R_B, G_B, and B_B remain open. As a result, the first R channel data R0<6> is output to the R channel line R0 of the first source line 312 and the R channel line R1 of the second source line 314 through the first R channel buffer R0_BUF, the first G channel data G0<6> is output to the G channel line G0 of the first source line 312 and the G channel line G1 of the second source line 314 through the first G channel buffer G0_BUF, and the first B channel data B0<6> is output to the B channel line B0 of the first source line 312 and the B channel line B1 of the second source line 314 through the first B channel buffer B0_BUF.

The display panel driving circuit 300 according to the present embodiment can drive a buffer corresponding to a cell and output the same data to two neighboring cells, thereby greatly reducing current consumption. Since the internal memory 302 rearranges and stores data for the same color channel in neighboring positions, and is transmitted from the data to the latch unit 308 to the data comparator 310 in parallel, the routing space between the latch unit 308 and the data comparator 310 is greatly reduced. Further, since it is not necessary to change an order of lines when the latch unit 308 transfers data of each channel to the data comparator 310, all of the data lines can be connected in parallel, thereby minimizing an arrangement area of a source driver.

Figure 4:
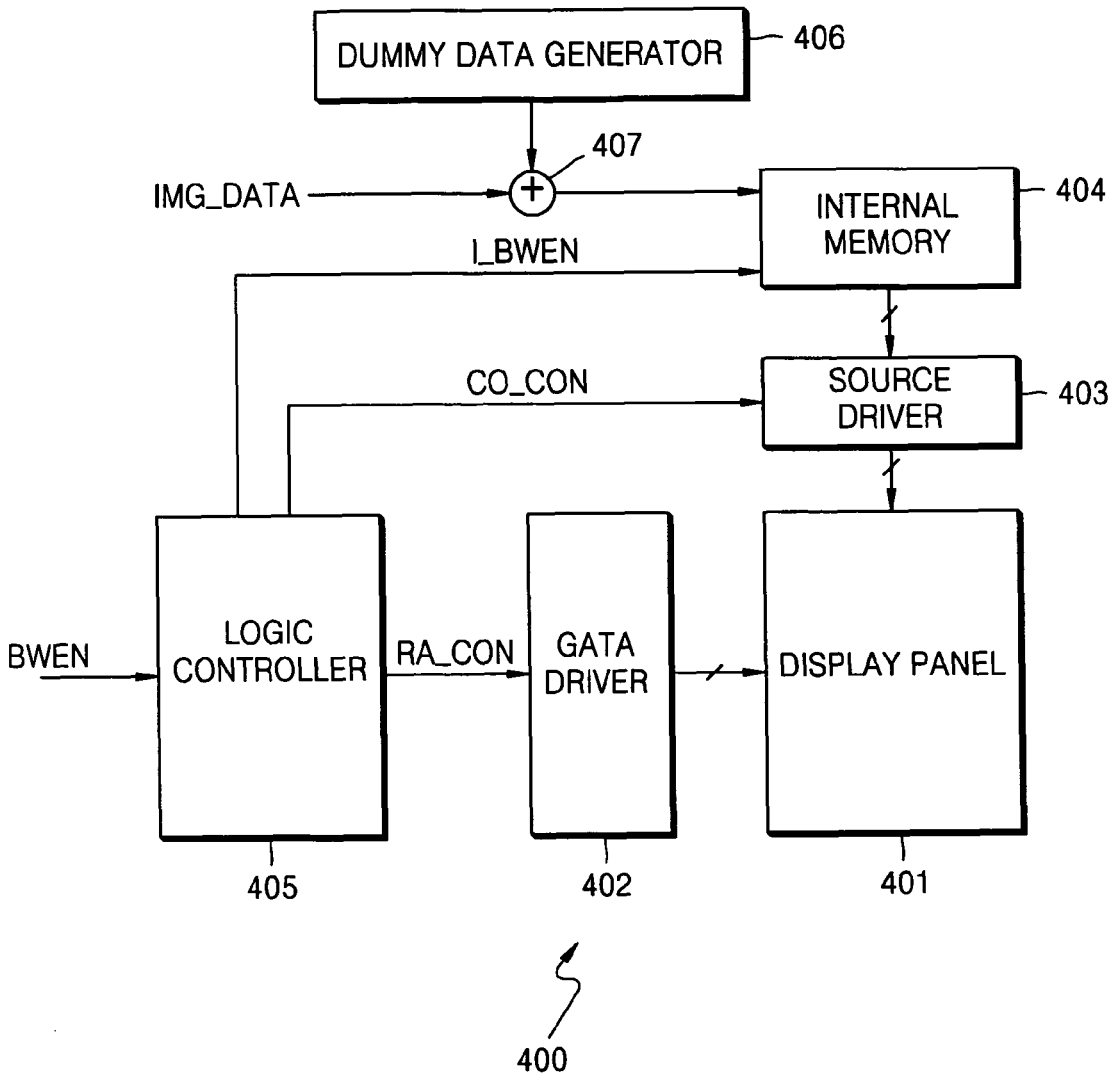
FIG. 4 is a block diagram of a display device that rearranges image data according to an embodiment of the present invention.

FIG. 4 is a block diagram of a display device that rearranges image data according to an embodiment of the present invention. Referring to FIG. 4, the display device 400 comprises a display panel 401, a gate driver 402, a source driver 403, an internal memory 404, a logic controller 405, a dummy data generator 406, and a summation unit 407.

The display panel 401 displays image data output from the source driver 403 on a low line selected from the gate driver 402. The gate driver 402 sequentially activates low lines of the display panel 401 in response to a control signal RA_CON output from the logic controller 405. The source driver 403 transfers data read from the internal memory 404 to the display panel 401 in response to a control signal CO_CON output from the logic controller 405. The internal memory 404 rearranges and stores the input image data in a predetermined source line unit such that channels having the same color are neighbored. The logic controller 405 controls the gate driver 402, the source driver 403, and the internal memory 404. The dummy data generator 406 generates dummy data with the same number of bits as the input image data. The summation unit 407 sums the image data IMG_DATA input externally and the dummy data generated by the dummy data generator 406 and outputs the summed data to the internal memory 404.

If each channel provides 6-bit data and data corresponding to a source line contains 18 bits, the image data IMG_DATA is input in units of 18 bits externally. The dummy data generator 406 generates and outputs 18-bit dummy data. The summation unit 407 cross-sums the 18-bit image data and the 18-bit dummy data, generates 36-bit data, and outputs the generated data to the internal memory 404. For example, if the image data of the first source line 312 shown in FIG. 3 is input, the summation unit 407 cross-sums 6-bit units of data from the 18-bit image data and 6-bit units of data from the 18-bit dummy data so that the 18-bit image data is stored in odd registers and the 18-bit dummy data is stored in even registers. If the image data of the second source line 312 shown in FIG. 3 is input, the summation unit 407 cross-sums 6-bit units of data from the 18-bit image data and 6-bit units of data from the 18-bit dummy data so that the 18-bit image data is stored in the even registers and the 18-bit dummy data is stored in the odd registers.

The logic controller 405 generates an internal bit write enable signal I_BWEN that repeatedly transitions between a first logic state and a second logic state each time image data of a source line is input and outputs the generated internal bit write enable signal I_BWEN in response to a bit write enable signal BWEN input externally. For example, the internal bit write enable signal I_BWEN is in the first logic state (e.g., logic low) when data for the first source line 312 shown in FIG. 3 is input, and the internal bit write enable signal I_BWEN is in the second logic state (e.g., logic high) when data for the second source line 314 shown in FIG. 3 is input.

The internal memory 404 stores image data of the first source line 312 in response to the internal bit write enable signal I_BWEN in the first logic state if the image data of the first source line 312 is input, and image data of the second source line 314 in response to the internal bit write enable signal I_BWEN in the second logic state if the image data of the second source line 314 is input.

FIGS. 5A through 5D are block diagrams and timing diagrams illustrating a method of storing data of an internal memory according to an embodiment of the present invention.

Figure 5A:
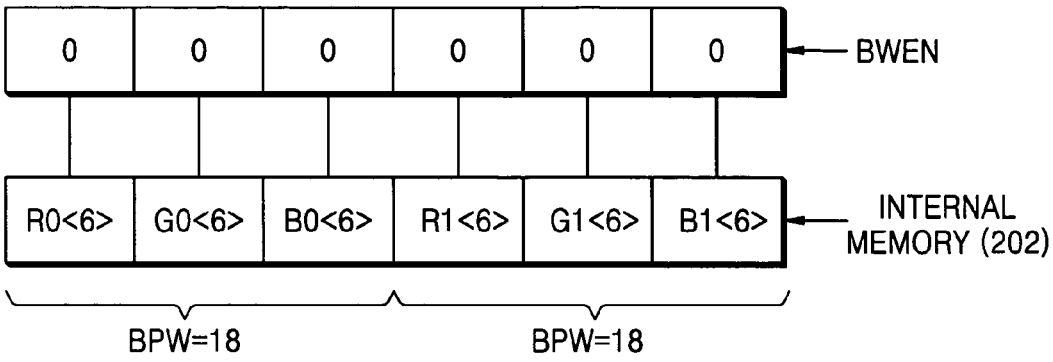
FIGS. 5A through 5D are block diagrams and timing diagrams illustrating a method of storing data of an internal memory according to an embodiment of the present invention.

FIG. 5A is a block diagram illustrating the relationship between the conventional internal memory 202 shown in FIG. 2 and the bit write enable signal BWEN. Every register of the internal memory 20 stores image data when the bit write enable signal BWEN is logic low. The BPW (bits per word) of the input image data is 18, which is the same amount as that of image data of a source line unit.

Figure 5B:
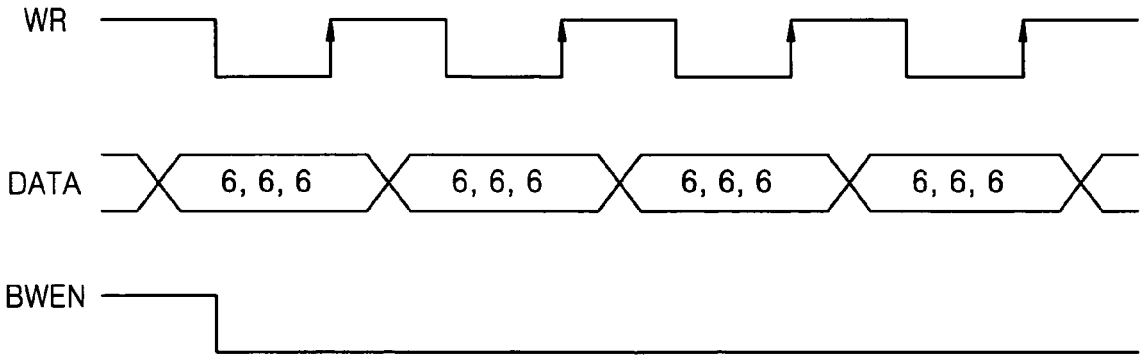

FIG. 5B is a timing diagram of the conventional data and control signals used in the conventional display panel driving circuit shown in FIG. 2. WR is a write control signal. Data is written on rising edges of WK. DATA is image data input to the internal memory. A word is 18-bit data designated to a source line.

Figure 5C:
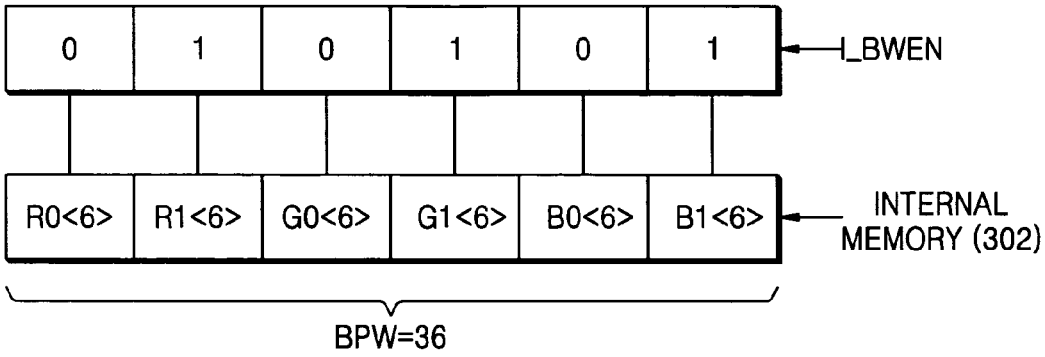

FIG. 5C is a block diagram illustrating the relationship between the internal memory 302 according to the embodiment of the present invention and the internal bit write enable signal I_BWEN. Referring to FIG. 5C, data is written to an odd register of the internal memory 302 when the internal bit write enable signal I_BWEN is logic low and data is written to an even register of the internal memory 302 when the internal bit write enable signal I_BWEN is logic high.

Figure 5D:
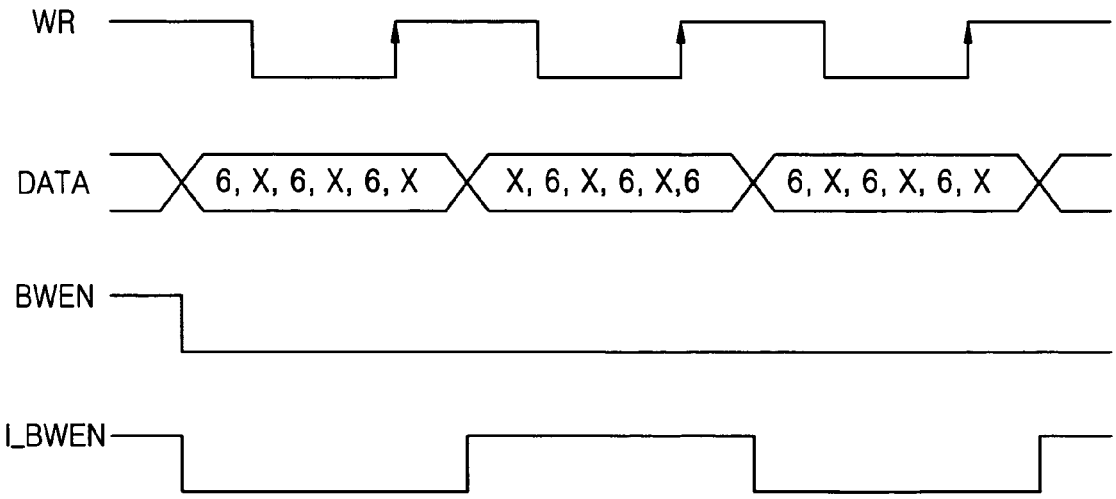

FIG. 5D is a timing diagram of the data and control signals shown in FIG. 3 according to an embodiment of the present invention. Referring to FIG. 5D, the BPW of data input in the internal memory is 36 as a result pf the cross-summing of the 18-bit image data and the 18-bit dummy data.

Referring to FIGS. 5C and 5D, when the internal bit write enable signal I_BWEN is logic low, the input data of the internal memory 302 is stored in an odd register. Referring to FIG. 4, when the image data and the dummy data of the first source line are summed, since 6-bit data from the 18-bit image data and 6-bit data from the 18-bit dummy data are cross-summed so that the 18-bit image data is stored in the odd registers and the 18-bit dummy data is stored in the even registers, the dummy data of the 36-bit input data is not stored in the even registers and the image data of the first source line is stored in the odd registers.

When the internal bit write enable signal I_BWEN is logic high, the input data of the internal memory is stored in the even registers. Referring to FIG. 4, when the image data and the dummy data of the second source line are summed, since 6-bit data from the 18-bit image data and 6-bit data from the 18-bit dummy data are cross-summed so that the 18-bit image data is stored in the even registers and the 18-bit dummy data is stored in the odd registers, the dummy data of the 36-bit input data is not stored in the odd registers and the image data of the second source line is stored in the even registers.

As a result, the image data of the first source line is stored in the odd registers of the internal memory and the image data of the second source line is stored in the even registers. Since the R channel data, G channel data, and G channel data are sequentially input externally, data of the same channels are neighbored in the internal memory.

The above embodiments compare data of two cells. However, data of three or more cells can be compared and a buffer can be driven when data of three or more three cells are identical to one another.

Figure 6:
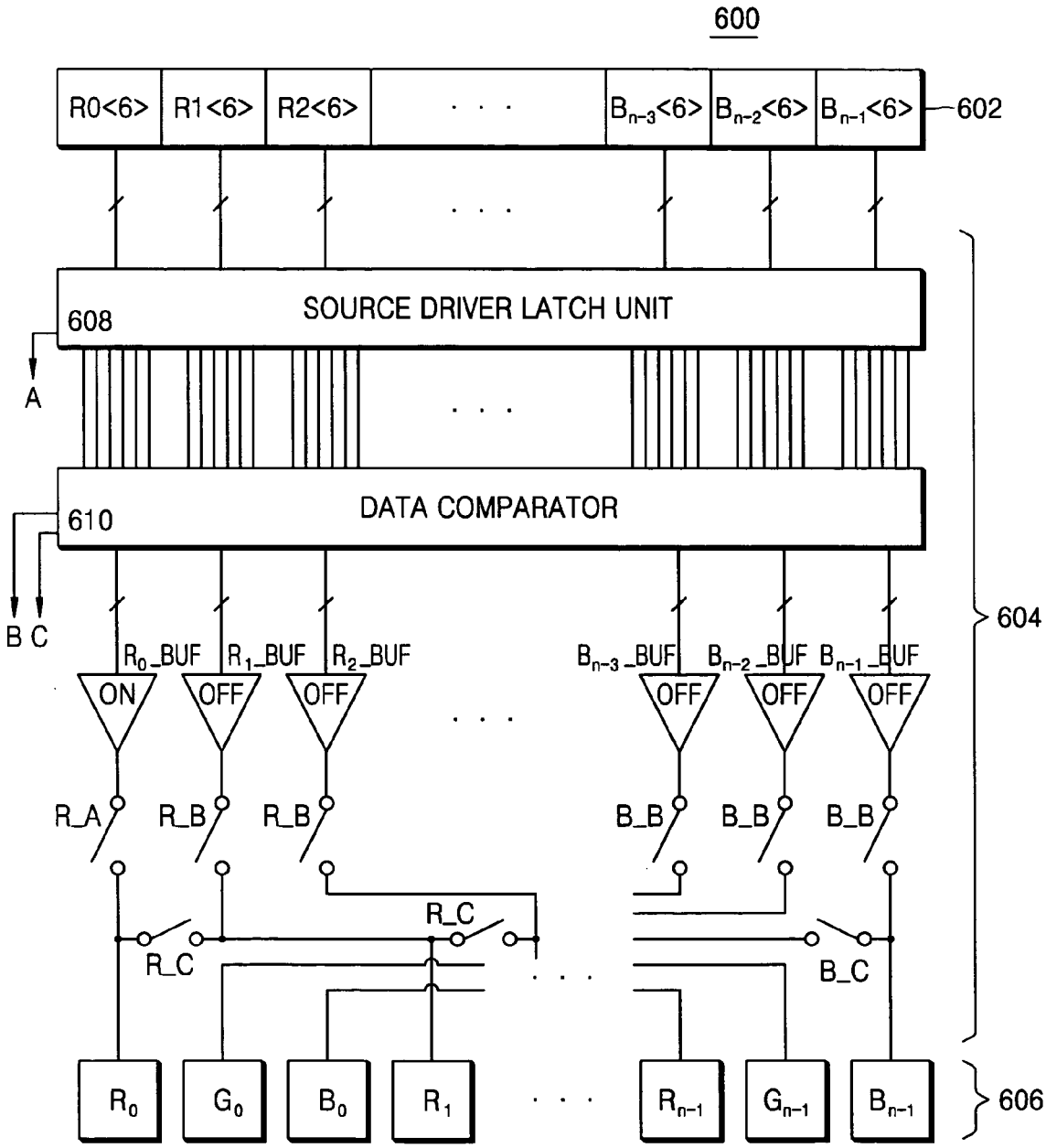
FIG. 6 is a circuit diagram of a display panel driving circuit according to an embodiment of the present invention.

FIG. 6 is a circuit diagram of a display panel driving circuit according to an embodiment of the present invention. The display panel driving circuit 600 determines whether data of n source line units are identical and outputs image data according to the determination. Referring to FIG. 6, the display panel driving circuit 600 comprises an internal memory 602, a source driver 604, and a panel 606. The source driver 604 includes a latch unit 608, a data comparator 610, a plurality of channel buffers R0_BUF through Rn-1_BUF, G0_BUF through Gn-1_BUF, and B0_BUF through Bn-1_BUF, a switch R_A, a plurality of switches R_B, a plurality of switches R_C, a switch G_A, a plurality of switches G_B, a plurality of switches G_C, a switch B_A, a plurality of switches B_B, and a plurality of switches B_C.

The internal memory 602 receives image data input of n source lines externally, rearranges and stores the image data so that channels having the same color neighbor each other.

The latch unit 608 latches image data corresponding to the n source lines output from the internal memory 602 and simultaneously outputs a first switching signal A. The data comparator 610 compares channel data output in parallel from the latch unit 608, determines whether the image data of the n source lines are identical, and outputs a second switching signal B or a third switching signal C according to the determination. The data comparator 610 activates or deactivates each channel buffer according to the comparison and outputs image data from the activated channel buffer.

The plurality of R channel buffers R0_BUF through Rn-1_BUF amplify the R channel data of each of the source lines, the plurality of G channel buffers G0_BUF through Gn-1_BUF amplify the G channel data of each of the source lines, and the plurality of B channel buffers B_BUF through Bn-1_BUF amplify the B channel data of each of the source line.

The switch R_A connects the R channel buffer R0_BUF to an R channel line R0, the switches R_B respectively connect the R channel buffers R1_BUF through Rn-1_BUF to R channel lines R1 through Rn-1, and the switches R_C connect the output nodes of the switch R_A and the output nodes of the switches R_B. The switch G_A connects the G channel buffer G0_BUF to an G channel line G0, the switches G_B respectively connect the G channel buffers G1_BUF through Gn-1_BUF to R channel lines G1 through Gn-1, and the switches G_C connect the output nodes of the switch G_A and the output nodes of the switches G_B. The switch B_A connects the B channel buffer B0_BUF to an B channel line B0, the switches B_B respectively connect the B channel buffers B1_BUF through Bn-1_BUF to B channel lines B1 through Bn-1, and the switches B_C connect the output nodes of the switch B_A and the output nodes of the switches B_B.

The switches R_A, G_A, and B_A are closed in response to the first switching signal A, the switches R_B, G_B, and B_B are closed in response to the second switching signal B, and the switches R_C, G_C, and B_C are closed in response to the third switching signal C.

If the image of data corresponding to the n source lines are different, the channel buffers R0_BUF through Rn-1_BUF, G0_BUF through Gn-1_BUF, and B0_BUF through Bn-1_BUF are directly connected to the channel lines R0 through Rn-1, G0 through Gn-1, and B0 through Bn-1, respectively, and if the n data are identical, one of each of the R channel buffers R0_BUF through Rn-1_BUF, the G channel buffers G0_BUF through Gn-1_BUF, and the B channel buffers B0_BUF through Bn-1_BUF is activated and connected to each of the R channel lines of R0 through Rn-1, G0 through Gn-1, and B0 through Bn-1, respectively.

Figure 7:
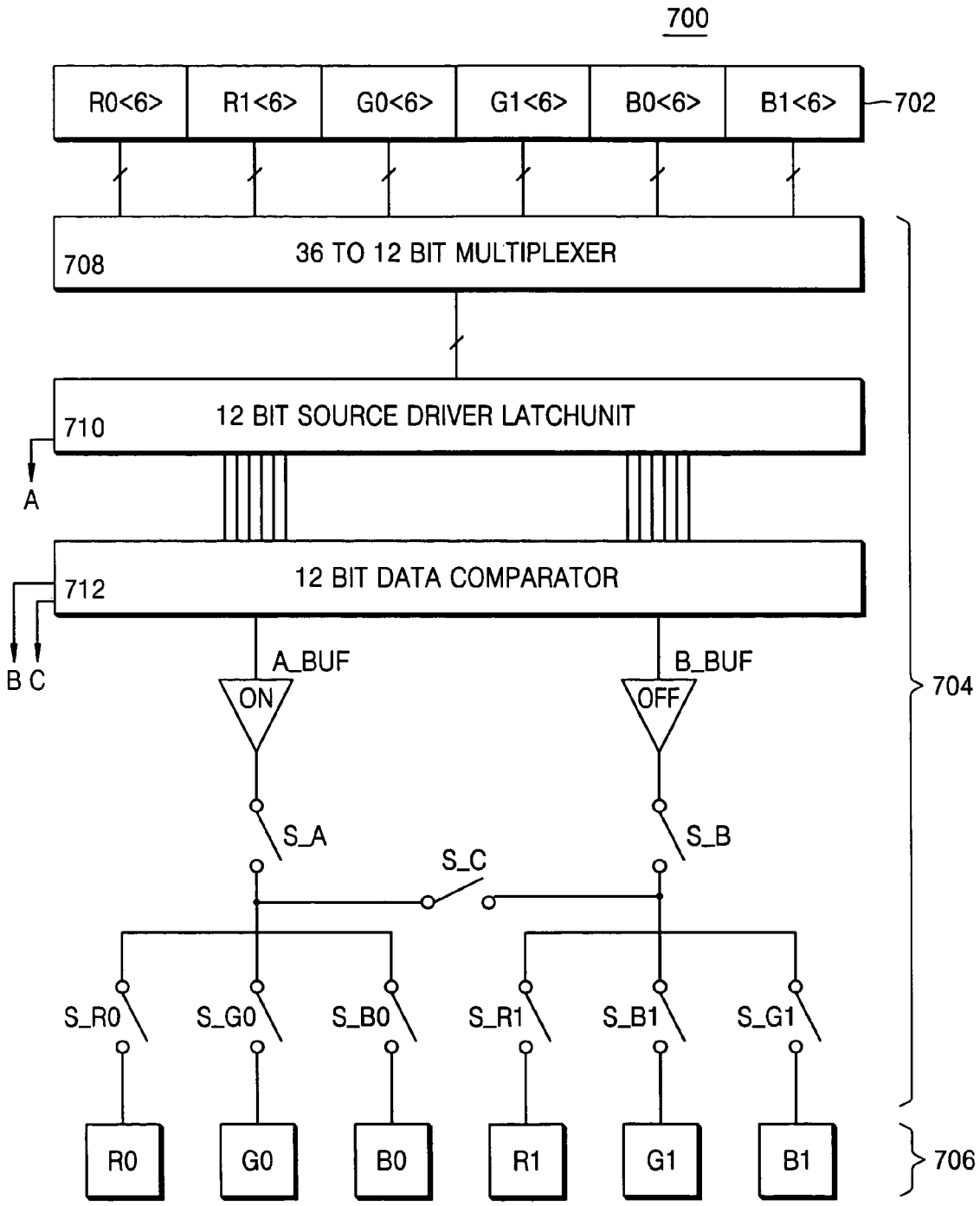
FIG. 7 is a circuit diagram of a display panel driving circuit according to an embodiment of the present invention.

FIG. 7 is a circuit diagram of a display panel driving circuit according to an embodiment of the present invention. Referring to FIG. 7, the display panel driving circuit 700 includes an internal memory 702, a source driver 704, and a panel 706. The source driver 704 includes a multiplexer 708, a latch unit 710, a data comparator 712, a first buffer A_BUF, a second buffer B_BUF, a first switch S_A connected to an output node of the first buffer A_BUF, a second switch S_B connected to an output node of the second buffer B_BUF, a third switch S_C connected to an output node of the first switch S_A and an output node of the second switch S_B, a channel switch S_R0 connected between the first switch S_A and an R channel line R0 of a first source line, a channel switch S_G0 connected between the first switch S_A and a G channel line G0 the first source line, a channel switch S_B0 connected between the firs switch S_A and a B channel line B0 of the first source line, a channel switch S_R1 connected between the second switch S_B and an R channel line R of a second source line, a channel switch S_G1 connected between the second switch S_B and a G channel line G1 of the second source line, and a channel switch S_B1 connected between the second switch S_B and a B channel line B1 of the second source line.

The display panel driving device 700 shown in FIG. 7 uses a three channel amplifier that sequentially outputs data of the R, G, and B channels using a buffer.

Similar to the internal memory 302 in FIG. 3, the internal memory 702 receives image data input of the predetermined number of external source lines, and rearranges and stores the image data so that channels having the same color neighbor one another. The internal memory 702 rearranges and stores image data of two source lines so that data of the R, G, and B channels neighbor each other.

The 36- to 12-bit multiplexer 708 outputs 12-bit data of the same channel from 36-bit image data read from the internal memory 702. The 36- to 12-bit multiplexer 708 sequentially outputs 12-bit data including first R channel data R0<6> and second R channel data R1<6> 12-bit data including first G channel data G0<6> and second G channel data G1<6>, and 12-bit data including first B channel data B0<6> and second B channel data B1<6> to the latch unit 710.

The latch unit 710 receives and latches the 12-bit data and simultaneously outputs the first switching signal A. The data comparator 712 receives and latches the 12-bit data and determines whether the 6-bit channel data of the first source line is identical to the 6-bit channel data of the second source line. The data comparator 712 outputs the second switching signal B if the 6-bit channel data of the first source line is not identical to the 6-bit channel data of the second source line, and the third switching signal C if the 6-bit channel data of the first source line is identical to the 6-bit channel data of the second source line.

The first switch S_A is activated in response to the first switching signal A, the second switch S_B is activated in response to the second switching signal B, and the third switch S_C is activated in response to the third switching signal C. The channel switches S_R0, S_G0, and S_B0 of the first source line and the channel switches S_R1, S_G1, and S_B1 of the second source line are sequentially activated.

If the data comparator 712 determines that the 6-bit channel data of the first source line is different from the 6-bit channel data of the second source line, the first and second switches S_A and S_B are closed in response to the first switching signal A and the second switching signal B, and the channel data of the first and second source lines are respectively transferred to the panel through the buffers A_BUF and B_BUF. If the data comparator 712 determines that the 6-bit channel data of the first source line are identical to the 6-bit channel data of the second source line, the first and third switches S_A and S_C are closed in response to the first switching signal A and the third switching signal C, the first buffer A_BUF is activated, and the channel data of the first source line is transferred to the first and second source lines of the panel.

In the embodiment shown in FIG. 7, the 6-bit channel data other than the 18-bit source line data are compared to control switches of the R, G, and B channels, thereby efficiently reducing current consumption.

Figure 8:
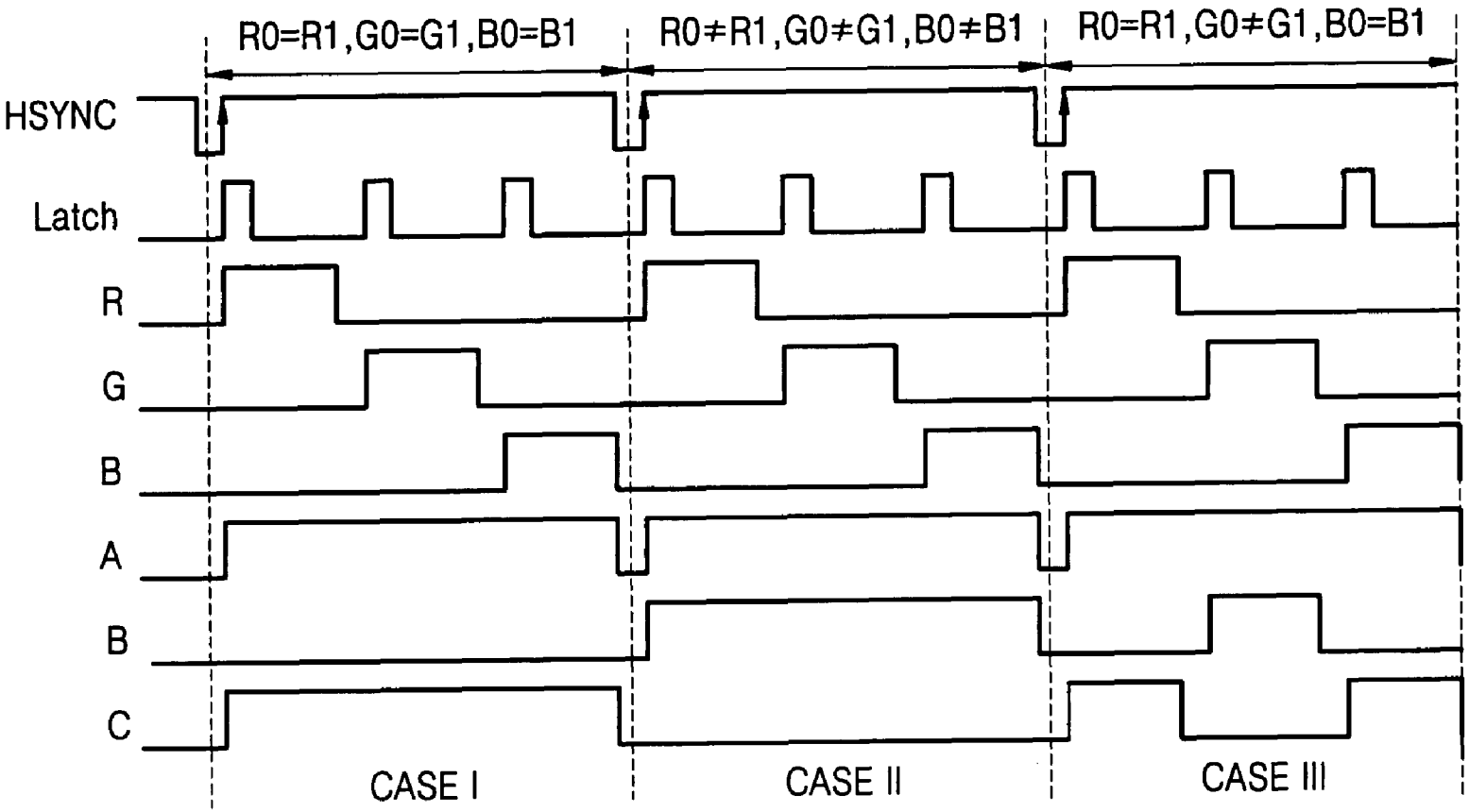
FIG. 8 is a timing diagram of a switching signal in the display panel driving circuit shown in FIG. 7 according to three cases.

FIG. 8 is a timing diagram of a switching signal in the display panel driving circuit shown in FIG. 7 according to three cases. Referring to FIG. 8, in case I, the R channel data for the first and second source lines are identical, the G channel data for the first and second source lines are identical and the B channel data for the first and second source lines are identical; in case II, the R channel data for the first and second source lines are not identical, the G channel data for the first and second source lines are not identical and the B channel data for the first and second source lines are not identical; and in case III, the R channel data for the first and second source lines are identical, the B channel data for the first and second source lines are identical and the G channel data for the first and second source lines are not identical.

An R switching signal R for toggling the channel switches S_R0 and S_R1, a G switching signal G for toggling the channel switches S_G0 and S_G1, and a B switching signal B for toggling the channel switches S_B0 and S_B1 are sequentially transitioned to a logic high state to sequentially connect each channel to the first and/or second buffers A_BUF and/or B_BUF.

In case I, when the R channel data is output, the first buffer A_BUF is driven to transfer the R channel data to the R channel lines R0 and R1, when the G channel data is output, the first buffer A_BUF is driven to transfer the G channel data to the G channel lines G0 and G1, and when the B channel data is output, the first buffer A_BUF is driven to transfer the B channel data to the B channel lines B0 and B1.

In case II, when the R channel data is output, the R channel data R0 of the first source line is transferred via the first buffer A_BUF and the R channel data R1 of the second source line is transferred via the second buffer B_BUF, when the G channel data is output, the G channel data G0 of the first source line is transferred via the first buffer A_BUF and the G channel data G1 of the second source line is transferred via the second buffer B_BUF, and when the B channel data is output, the B channel data B0 of the first source line is transferred via the first buffer A_BUF and the B channel data B1 of the second source line is transferred via the second buffer B_BUF.

In the case III, when the R channel data is output, the first buffer A_BUF is driven to transfer the R channel data to the R channel lines R0 and R1, when the G channel data is output, the G channel data of the first source line is transferred via the first buffer A_BUF and the G channel data G1 of the second source line is transferred via the second buffer B_BUF, and when the B channel data is output, the first buffer A_BUF is driven to transfer the B channel data to the B channel lines B0 and B1 of the panel 706.

Figure 9:
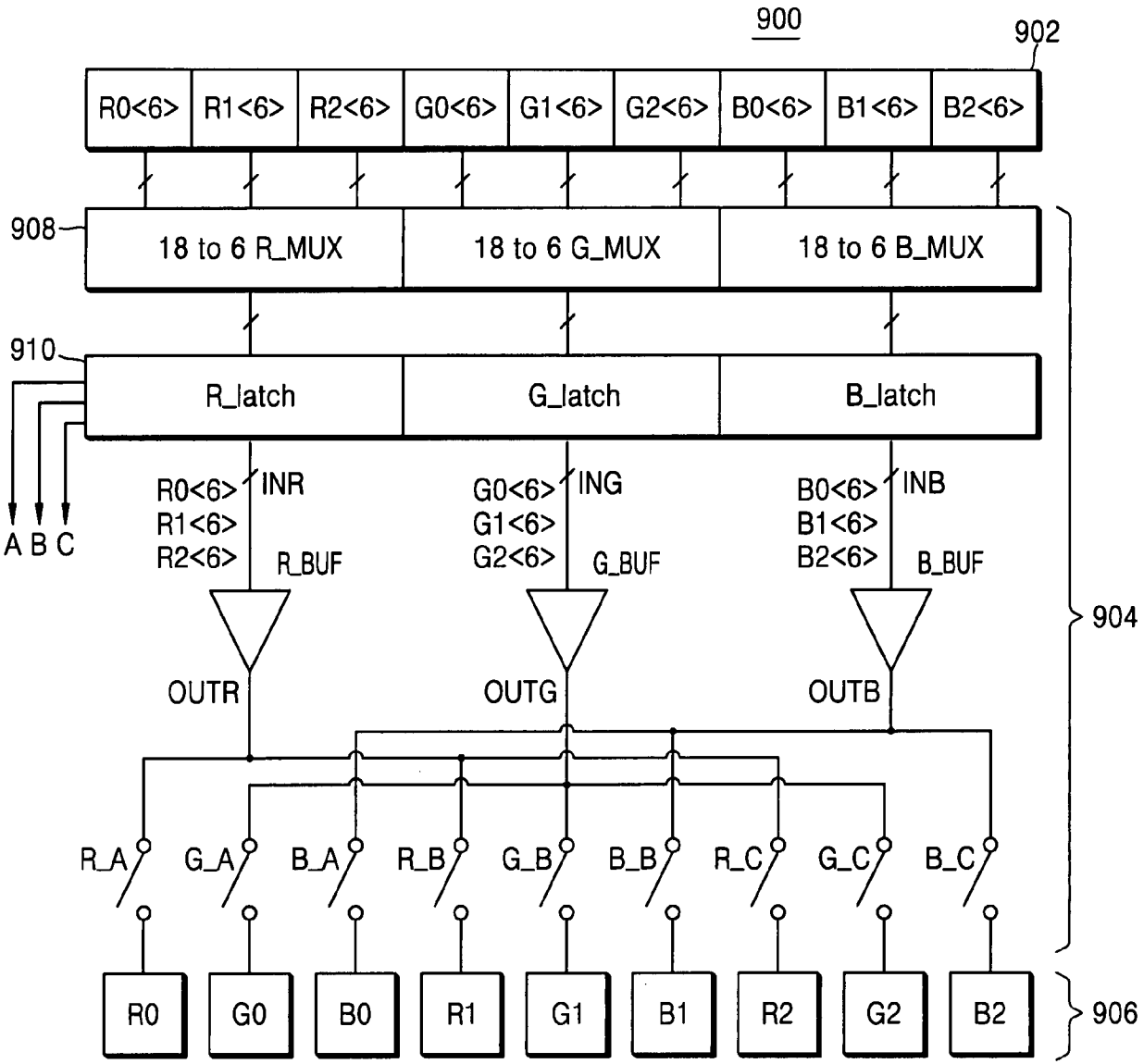
FIG. 9 is a circuit diagram of a display panel driving circuit according to an embodiment of the present invention.

FIG. 9 is a circuit diagram of a display panel driving circuit according to an embodiment of the present invention. The display panel driving circuit 900 does not compare input image data of each source line but changes a write/read scheme of internal memory and sequentially outputs data of each source line.

Referring to FIG.9, display panel driving circuit 900 comprises an internal memory 902, a source driver 904, and a panel 906. The source driver 904 comprises a multiplexer unit 908 including an R channel multiplexer R_MUX, a G channel multiplexer G_MUX, and a B channel multiplexer B_MUX, and a latch unit 910 including an R channel latch R_latch, a G channel latch G_latch, and a B channel latch B_latch.

The R channel multiplexer R_MUX receives R channel data of image data of a plurality of source lines stored in the internal memory 902 and sequentially outputs the R channel data of each of the source lines. The G channel multiplexer G_MUX receives G channel data of image data of a plurality of source lines stored in the internal memory 902 and sequentially outputs the G channel data of each of the source lines. The B channel multiplexer B_MUX receives B channel data of image data stored in the internal memory 902 and sequentially outputs the B channel data of each source line. Since data of each channel contains 6 bits, the R channel multiplexer R_MUX is an 18 to 6 bit multiplexer that receives 18-bit R channel data R0<6>, R1 <6>, and R2<6> and sequentially outputs 6-bit first R channel data R0<6>, 6-bit second R channel data R1<6>, and 6-bit third R channel data R2<6>, the G channel multiplexer G_MUX is an 18 to 6 bit multiplexer that receives 18-bit G channel data G0<6>, G1<6>, and G2<6>, and sequentially outputs 6-bit first G channel data G0<6>, 6-bit second G channel data G1<6>, and 6-bit third G channel data G2<6>, and the B channel multiplexer B_MUX is an 18 to 6 bit multiplexer that receives 18-bit B channel data B0<6>, B1<6>, and B2<6>, and sequentially outputs 6-bit first B channel data B0<6>, 6-bit second B channel data B1 <6>, and 6-bit third B channel data B2<6>.

The R channel latch R_latch is a 6-bit latch unit that receives and latches the 6-bit first R channel data R0<6>, the 6-bit second R channel data R1 <6>, and the 6-bit third R channel data R2<6> which are sequentially output from the R channel multiplexer R_MUX. The G channel latch G_latch is a 6-bit latch unit that receives and latches the 6-bit first G channel data G0<6>, the 6-bit second G channel data G1<6>, and the 6-bit third G channel data G2<6> which are sequentially output from the G channel multiplexer G_MUX. The B channel latch B_latch is a 6-bit latch unit that receives and latches the 6-bit first B channel data B0<6>, the 6-bit second B channel data B1<6>, and the 6-bit third B channel data B2<6> which are sequentially output from the B channel multiplexer B_MUX.

The source driver 904 includes an R channel buffer R_BUF that amplifies the R channel data output from the R channel latch R_latch, a G channel buffer G_BUF that amplifies the G channel data output from the G channel latch G_latch, and a B channel buffer B_BUF that amplifies the B channel data output from the B channel latch B_latch. The source driver 904 includes a plurality of R channel switches R_A, R_B, and R_C for transferring the output image data of the R channel buffer R_BUF to a plurality of R channel lines R0, R1, and R2 of each source line, a plurality of G channel switches G_A, G_B, and G_C for transferring the output image data of the G channel buffer G_BUF to a plurality of G channel lines G0, G1, and G2 of each source line, and a plurality of B channel switches B_A, B_B, and B_C for transferring the output image data of the B channel buffer B_BUF to a plurality of B channel lines B0, B1, and B2 of each source line.

The switches R_A, G_A, and B_A are activated by a first switching signal A, the switches R_B, G_B, and B_B are activated by a second switching signal B, the switches R_C, G_C, and B_C are activated by a third switching signal C. The first, second, and third switching signals A, B, and C are sequentially activated to output image data for each source line.

The switching signals A, B, and C can be output by the latch unit 910 or by a logic controller (not shown).

The method of storing image data input externally in the internal memory 902 in the present embodiment of FIG. 9 is identical to those used in the embodiments of FIGS. 4 and 5. Therefore, a method of rearranging image data in the internal memory 902 will not be provided.

Figure 10:
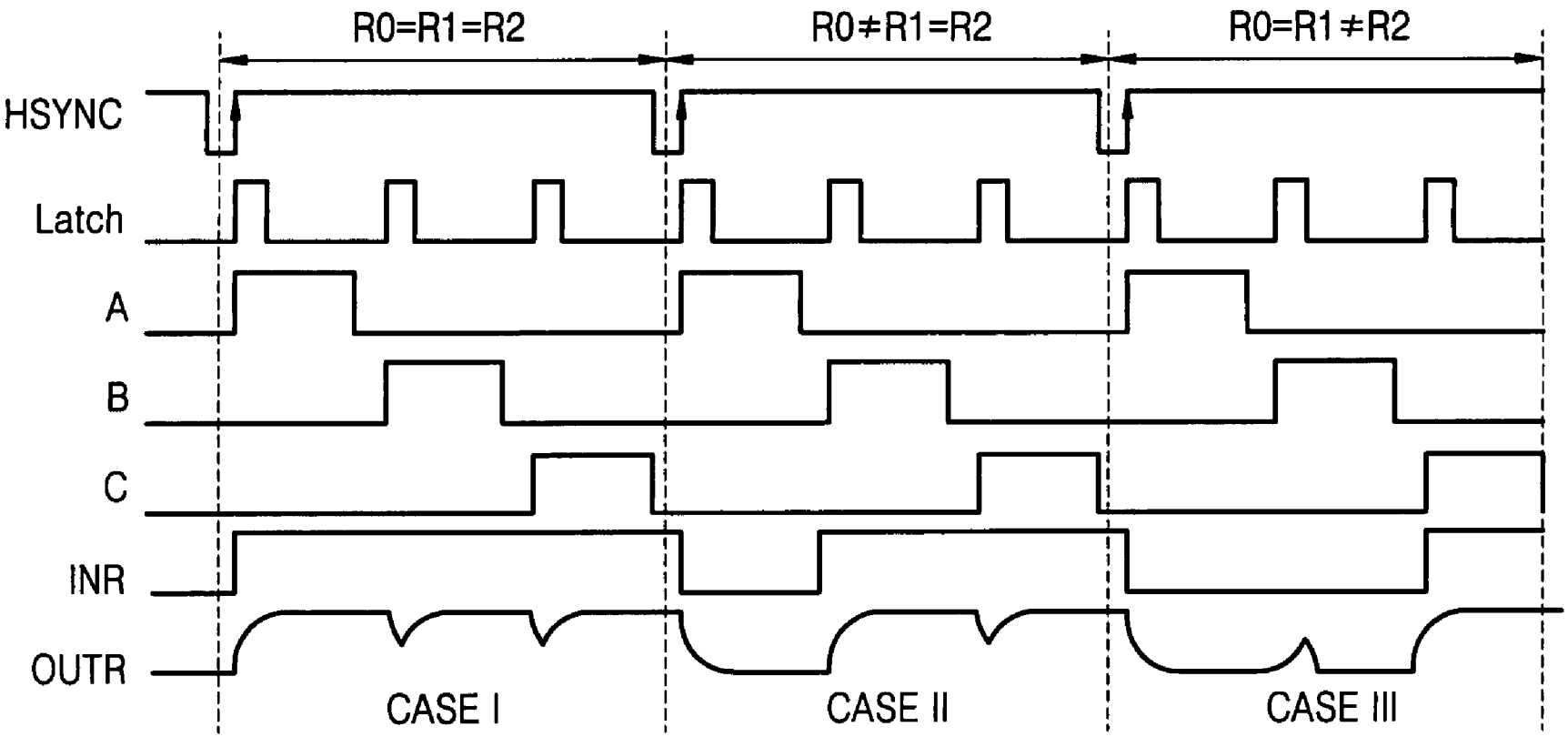
FIG. 10 is a timing diagram illustrating three cases in which R channel data is output by the display panel driving circuit shown in FIG. 9.

FIG. 10 is a timing diagram illustrating three cases in which the R channel data is output by the display panel driving circuit 900 shown in FIG. 9. FIG. 10 illustrates the relationship between signals when R channel data that are identical or different are sequentially output.

The source driver 904 outputs data a horizontal synchronization signal HSYNC is logic high. A latch signal Latch is input to the latch unit 910. When Latch is in a logic high state, the first R channel data R0<6> of the first source line is latched, when Latch is subsequently in a logic high state, the second R channel data R1<6> of the second source line is latched, and when Latch is again in a logic high state, the third R channel data R2<6> of the third source line is latched.

The first switching signal A is supplied to the switch R_A connected to the first source line, the second switching signal B is supplied to the switch R_B connected to the second source line, and the third switching signal C is supplied to the switch R_C connected to the third source line. If the first switching signal A is logic high, the first R channel data R0<6> is transferred to the first source line, if the second switching signal B is logic high, the second R channel data R1<6> is transferred to the second source line, and if the third switching signal C is logic high, the third R channel data R2<6> is transferred to the third source line.

INR denotes an input data signal of the R channel buffer R_BUF, and OUTR denotes an output data signal of the R channel buffer R_BUF.

In case I, the R channel data of the first, second, and third source lines are identical. In this case, since INR input to the R channel buffer R_BUF has the same value when the first, second, and third switching signals A, B, and C are sequentially supplied, the OUTR output from the R channel buffer R_BUF has the same value except when the switching signals in the logic high state is changed. Therefore, the same data are transferred to the three source lines using the R channel buffer R_BUF only, thereby reducing current consumption. That is, when the level of signals which are continuously input/output is regular, dynamic current of the R channel buffer R_BUF is constant and load current is only necessary, thereby reducing current consumption.

In case II, the first R channel data R0<6> is different from the second R channel data R1 <6>, and the second R channel data R1 <6> is identical to the third R channel data R2<6>. In this case, INR input to the R channel buffer R_BUF is different when the first and second switching signals A and B are supplied, and OUTR output from the R channel buffer R_BUF is changed according to INR. The image data transferred to the first source line has a different value than the image data transferred to the second source line. INR has the same value when the second and third switching signals B and C are supplied, and the OUTR has the same value except when the switching signal in the logic high state is changed, and the image data transferred to the second and third source lines are identical.

In case III, the first R channel data R0<6> is identical to the second R channel data R1 <6>, and the second R channel data R1 <6> is different from the third R channel data R2<6>. INR has the same value when the first switching signal A and the second switching signal B are supplied, and OUTR has a constant value except when the switching signal in the logic high state is changed. Therefore, the image data transferred to the first source line and the second source line are identical. INR is different when the second switching signal B and the third switching signal C are supplied, and, OUTR changes according to the change in INR. The image data transferred to the second source line and the third source line have different values.

In the same manner as the display panel driving device 700 shown in FIG. 7, the display panel driving device 900 shown in FIG. 9 compares 6-bit data of each channel other than 18-bit source line data and performs switching for each channel, thereby efficiently reducing current consumption.

When a display panel driving circuit uses a multi-channel, it is necessary for the delay timing of a source driver to be short. When a buffer is activated or deactivated by comparing data in the display panel driving circuit using the multi-channel, delay timing of the buffer fails. However, in the display panel driving device 900 shown in FIG. 9, since image data is rearranged in the internal memory 902 and a plurality of source lines are driven without comparing data, the display panel driving circuit using the multi-channel can perform a high-speed operation.

To be more specific, when each R/G/B data of neighboring cells are identical, an input/output level of a buffer of a source driver is constant. Therefore, current flowing through the buffer is constant and only a load current is supplied, thereby reducing power consumption of the buffer by more than 5% over conventional technology.

Although input image data of the same channel is stored in the internal memory 902 shown in FIG. 9, the R channel data R0<6>, the G channel data G0<6>, and the B channel data B0<6> can be exclusively stored in the internal memory 902. In this case, when the multiplexer 908 multiplexes data of the same channel, the display panel driving device 900 can produce the same output. In detail, even when the internal memory 902 does not store data for the same channel but sequentially stores image data, an internal multiplexer or connection lines are adjusted to use the structure of buffers and switches shown in FIG. 9.

According to the display panel driving circuit of the present invention, it is possible to greatly reduce current consumption and minimize an arrangement area of a source driver. As a result, it is possible to reduce the area of the display panel driving circuit and greatly reduce the current required to display data in a portable electronic device.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A display driving circuit comprising:

a source driver including a plurality of unit source drivers connected in parallel, the source driver connected to first and second source lines to control the first and second source lines;

memory configured to store image data of the first and second source lines and arranged with channels having the same color neighbor each other; and a display panel, wherein the plurality of unit source drivers comprises:

a data comparator receiving the image data of the first and second source lines from the memory, determining whether the image data of the first and second source lines are identical, outputting a first switching signal if the image data of the first and second source lines are determined to be different, and outputting a second switching signal if the image data of the first and second source lines are determined to be identical;

a plurality of buffers amplifying image data output from the data comparator; and a controller including a plurality of switches connected between the plurality of buffers and channel lines of the first and second source lines and outputting the image data output from the plurality of buffers to the channel lines of the first and second source lines in response to the first and second switching signals, wherein the controller activates buffers corresponding to one of the first and second source lines among the plurality of buffers in response to the second switching signal and deactivates the other buffers and transfers a signal output from the activated buffers to the channel lines of the first and second source lines, and wherein the image data of the first and second source lines includes first and second red (R), green (G), and blue (B) channel data of the first and second source lines, respectively, and the data comparator determines that the image data of the first source line is identical to the image data of the second source line if the first R channel data is identical to the second R channel data, the first G channel data is identical to the second G channel data, and the first B channel data is identical to the second B channel data.

2. The display driving circuit of claim 1, wherein the first and second source lines neighbor each other.

3. The display driving circuit of claim 1, wherein the first and second R, G, and B channel data, respectively, are determined to be identical if most significant bits (MSBs) and least significant bits (LSBs) of the first and second, R, G, and B channel data, respectively, match.

4. The display driving circuit of claim 1, further comprising: a logic controller generating and outputting an internal bit write enable signal that repeatedly transitions between a first logic state and a second logic state when image data of one of the first and second source lines is input in response to a bit write enable signal input externally, wherein the image data of the first and second source lines input externally are rearranged and stored in the memory so that channel lines of the first and second source lines having the same color neighbor each other in response to the internal bit write enable signal.

5. The display driving circuit of claim 1, wherein the memory stores the first R, G, and B channel data in odd registers of the memory when the internal bit write enable signal is in a first logic state, and stores the second R, G, and B channel data in even registers of the memory when the internal bit write enable signal is in a second logic state.

6. The display driving circuit of claim 4, further comprising:

a dummy data generator generating 3n-bit dummy data corresponding to each of first or second R, G, and B channel data containing n bits each; and a summation unit cross-summing the n-bit data of each of the first or second R, G, and B channel data of the 3n-bit dummy data and 3n-bit source line image data and generating 6n-bit data, wherein the memory stores pixel data of the first source line among a first 6n-bit data output from the summation unit when the internal bit write enable signal is in the first logic state, and pixel data of the second source line among a next 6n-bit data output from the summation unit when the internal bit write enable signal is in the second logic state.

7. The display driving circuit of claim 4, wherein the controller comprises:

a first R channel buffer amplifying the first R channel data of the first source line;

a first G channel buffer amplifying the first G channel data of the first source line;

a first B channel buffer amplifying the first B channel data of the first source line;

a first R switch connecting the first R channel buffer and an R channel pixel of the first source line;

a first G switch connecting the first G channel buffer and a G channel pixel of the first source line;

a first B switch connecting the first B channel buffer and a B channel pixel of the first source line;

a second R channel buffer amplifying the second R channel data of the second source line;

a second G channel buffer amplifying the second G channel data of the second source line;

a second B channel buffer amplifying the second B channel data of the second source line;

a second R switch connecting the second R channel buffer and an R channel pixel of the second source line;

a second G switch connecting the second G channel buffer and a G channel pixel of the second source line;

a second B switch connecting the second B channel buffer and a B channel pixel of the second source line;

a third R switch connecting output nodes of the first R switch and the second R switch;

a third G switch connecting output nodes of the first G switch and the second G switch; and a third B switch connecting output nodes of the first B switch and the second B switch, wherein the first R switch, the first G switch, the first B switch, the second R switch, the second G switch, and the second B switch are activated in response to the first switching signal, the third R switch, the third G switch, and the third B switch are deactivated in response to the first switching signal, the first R switch, the first G switch, the first B switch, the third R switch, the third G switch, and the third B switch are activated in response to the second switching signal, and the second R switch, the second G switch, and the second B switch are deactivated in response to the second switching signal.

8. The display driving circuit of claim 7, wherein the plurality of unit source drivers further comprise a latch unit latching the image data of the first and second source lines stored in the memory and outputting a third switching signal when the image data is latched, and the first R switch, the first G switch, and the first B switch are activated in response to the third switching signal.

9. A method of driving a display circuit, the method comprising:

rearranging and storing image data input externally according to a predetermined number of source lines so that channel data having the same color neighbor each other;

reading and latching the rearranged image data; determining whether the image data of the predetermined number of source lines are identical; and if the image data of the predetermined number of source lines are different, independently transferring the image data to corresponding source lines, and if the image data of the predetermined number of source lines are identical, activating one buffer connected to one of the source lines and deactivating buffers connected to remaining source lines, and transferring the output image data of the activated buffer to a source line connected to the deactivated buffer, wherein the image data of first and second source lines includes first and second red (R), green (G), and blue (B) channel data of the first and second source lines, respectively, and a data comparator determines that the image data of the first source line is identical to the image data of the second source line if a first R channel data is identical to a second R channel data, a first G channel data is identical to a second G channel data, and a first B channel data is identical to a second B channel data.

10. The method of claim 9, wherein the step of determining whether the image data of the predetermined number of source lines are identical comprises respectively comparing R, G, and B channel data.

* * * * *